US007805306B2

(12) United States Patent
Mitsui

(10) Patent No.: US 7,805,306 B2
(45) Date of Patent: Sep. 28, 2010

(54) VOICE GUIDANCE DEVICE AND NAVIGATION DEVICE WITH THE SAME

(75) Inventor: Takao Mitsui, Chita-gun (JP)

(73) Assignee: Denso Corporation, Kariya (JP)

( * ) Notice: Subject to any disclaimer, the term of this patent is extended or adjusted under 35 U.S.C. 154(b) by 1319 days.

(21) Appl. No.: 11/183,641

(22) Filed: Jul. 18, 2005

(65) Prior Publication Data

US 2006/0020472 A1 Jan. 26, 2006

(30) Foreign Application Priority Data

Jul. 22, 2004 (JP) ..... 2004-214363

(51) Int. Cl.
*G10L 13/00* (2006.01)

(52) U.S. Cl. ..... 704/258; 704/268; 704/270

(58) Field of Classification Search ..... 704/258, 704/260, 275, 268, 270
See application file for complete search history.

(56) References Cited

U.S. PATENT DOCUMENTS

| | | | | |
|---|---|---|---|---|
| 4,757,737 | A * | 7/1988 | Conti | 84/681 |
| 5,321,794 | A * | 6/1994 | Tamura | 704/260 |
| 5,621,182 | A * | 4/1997 | Matsumoto | 84/610 |
| 5,864,812 | A * | 1/1999 | Kamai et al. | 704/268 |
| 5,890,115 | A * | 3/1999 | Cole | 704/258 |
| 5,949,854 | A * | 9/1999 | Sato | 379/88.16 |
| 5,950,161 | A * | 9/1999 | Kozuma et al. | 704/260 |
| 6,253,182 | B1 * | 6/2001 | Acero | 704/268 |
| 6,577,998 | B1 * | 6/2003 | Yamamoto | 704/270 |
| 6,665,641 | B1 * | 12/2003 | Coorman et al. | 704/260 |
| 6,823,309 | B1 * | 11/2004 | Kato et al. | 704/267 |
| 7,203,648 | B1 * | 4/2007 | Ostermann et al. | 704/260 |
| 2001/0029454 | A1 * | 10/2001 | Yamada | 704/258 |
| 2002/0019736 | A1 * | 2/2002 | Kimura et al. | 704/260 |
| 2003/0055653 | A1 * | 3/2003 | Ishii et al. | 704/275 |
| 2003/0066414 | A1 * | 4/2003 | Jameson | 84/741 |
| 2004/0054537 | A1 * | 3/2004 | Morio et al. | 704/260 |

(Continued)

FOREIGN PATENT DOCUMENTS

| | | |
|---|---|---|
| JP | 06-001549 | 1/1994 |
| JP | 2000-315089 | 11/2000 |
| JP | 2002-229581 | 8/2002 |
| JP | 2003-150194 | 5/2003 |

OTHER PUBLICATIONS

Office action dated Jul. 14, 2009 in corresponding Japanese Application No. 2004-214363.

*Primary Examiner*—Richemond Dorvil
*Assistant Examiner*—Jialong He
(74) *Attorney, Agent, or Firm*—Harness, Dickey & Pierce, PLC

(57) ABSTRACT

For a voice guidance phrase, multiple voice data items having individually different voice ranges or frequencies are previously stored in a memory. A voice mixing unit chooses to mix three voice data items among the stored voice data items and thereby produces a mixed voice data item. A voice outputting unit converts the mixed voice data item into a voice and then vocalizes a voice guidance phrase via a speaker. A voice measuring unit measures a characteristic of a frequency, a volume, or a pronunciation speed with respect to a response voice responding to the outputted voice guidance phrase. A voice mixing unit produces a mixed voice data item having a characteristic similar to the measured characteristic and outputs it.

17 Claims, 2 Drawing Sheets

U.S. PATENT DOCUMENTS

2004/0148172 A1* 7/2004 Cohen et al. ..... 704/268
2005/0055211 A1* 3/2005 Claudatos et al. ..... 704/270
2006/0074672 A1* 4/2006 Allefs ..... 704/258
2006/0074677 A1* 4/2006 DeSimone ..... 704/261

* cited by examiner

VOICE GUIDANCE DEVICE AND NAVIGATION DEVICE WITH THE SAME

CROSS REFERENCE TO RELATED APPLICATIONS

This application is based on and incorporates herein by reference Japanese Patent Application No. 2004-214363 filed on Jul. 22, 2004.

FIELD OF THE INVENTION

The present invention relates to a voice guidance device, a voice guidance method, and a navigation device, all of which output synthesized voices.

BACKGROUND OF THE INVENTION

An automatic guidance by voice (audio) is practically used in a navigation device, an elevator, a vehicle, an automated teller machine, or the like. Voice guidance is set to a predetermined voice volume, so that senior people having weak hearing or hearing-impaired people cannot easily hear the voice guidance. Technologies to solve this problem are described in Patent Documents 1, 2.

Patent Document 1: JP-H6-1549 A

Patent Document 2: JP-2002-229581 A

In Patent Document 1, a voice guidance device functions as follows: An individual recognition means is installed in a cage or a platform of an elevator for recognizing a passenger; broadcast data corresponding to hearing-impaired people is read out from a broadcast data storing means by a broadcast command; and a voice corresponding to the broadcast command is outputted from a speaker.

In Patent Document 2, a voice output system includes the following: a voice output device for outputting voices; a voice converting device for converting frequencies, tempos, accents, voice volumes, provincialisms, etc. of the outputted voices; and a voice recognition degree analyzing device for analyzing users' recognition degrees with respect to the outputted voices or their contents.

The above individual recognition means in Patent Document 1 requires a large memory volume and an intelligent search system when the number of target people significantly increases. The above voice recognition degree analyzing device in Patent Document 2 is very complicated system that needs to retrieve data such as user information, vehicle states, environment information, etc. and to compare present data with data in standard states with respect to the retrieved data to thereby compute users' recognition degrees.

SUMMARY OF THE INVENTION

It is an object of the present invention to provide a voice guidance device, a voice guidance method, and a navigation device, each of which is able to perform voice guidance that is able to be heard by even senior people having weak hearing or hearing-impaired people.

To achieve the above object, a voice guidance device is provided with the following: A storing unit is included for storing a plurality of voice data items for at least one voice guidance phrase, wherein each of the plurality of voice data items has a different frequency; a voice mixing unit is included for mixing at least two voice data items of the stored plurality of voice data items to thereby produce a mixed voice data item; and a voice outputting unit is included for outputting a mixed voice based on the produced mixed voice data item.

As another aspect of the present invention, a voice guidance device is provided with the following: A storing unit is included for storing at least one voice data item for at least one voice guidance phrase; a voice producing unit is included for producing at least one voice data item for the voice guidance phrase from the stored at least one voice data item using voice synthesis, wherein each of the stored at least one voice data item and the produced at least one voice data item has a different frequency; a voice mixing unit is included for mixing at least two voice data items of the stored at least one voice data item and the produced at least one voice data item to thereby produce a mixed voice data item; and a voice outputting unit is included for outputting a mixed voice for the voice guidance phrase based on the produced mixed voice data item.

Under the above structures, with respect to a guidance voice phrase, voice data items individually having different frequencies are previously obtained by being produced or by retrieving from a storing unit. A voice mixing unit chooses to mix more than one voice data item among the obtained voice data items to thereby produce a mixed voice data item for the voice guidance phrase. Then, a voice outputting unit outputs a mixed voice based on the mixed voice data item.

The obtained voice data items have individually different frequencies or voice ranges such as a high range, a low range, and a medium range. The voice data items can be obtained by practically recording different voice ranges such as voices of a child, an adult, a male, or a female or by using a voice synthesis technology. Here, a voice includes various frequency components which determine a sound quality. In this case, attention can be focused on a main frequency component or several major frequency components.

Even senior people or hearing-impaired people having weak or poor hearing do not always have weak hearing in all the frequencies, but have often weak hearing selectively in a certain frequency. For instance, in senile weak hearing, weak hearing occurs in a high frequency or a high voice range, but relatively good hearing is observed in a low frequency or a low voice range. In the present invention, voice guidance takes place by using multiple frequencies at the same time, so that even senior people having weak hearing or hearing-impaired people can hear the voice guidance of the frequency where the hearing loss is relatively small.

BRIEF DESCRIPTION OF THE DRAWINGS

The above and other objects, features, and advantages of the present invention will become more apparent from the following detailed description made with reference to the accompanying drawings. In the drawings.

DETAILED DESCRIPTION OF THE PREFERRED EMBODIMENTS

The present invention is adapted to a car navigation device; an embodiment of the car navigation device 1 will be explained below.

Figure 1:
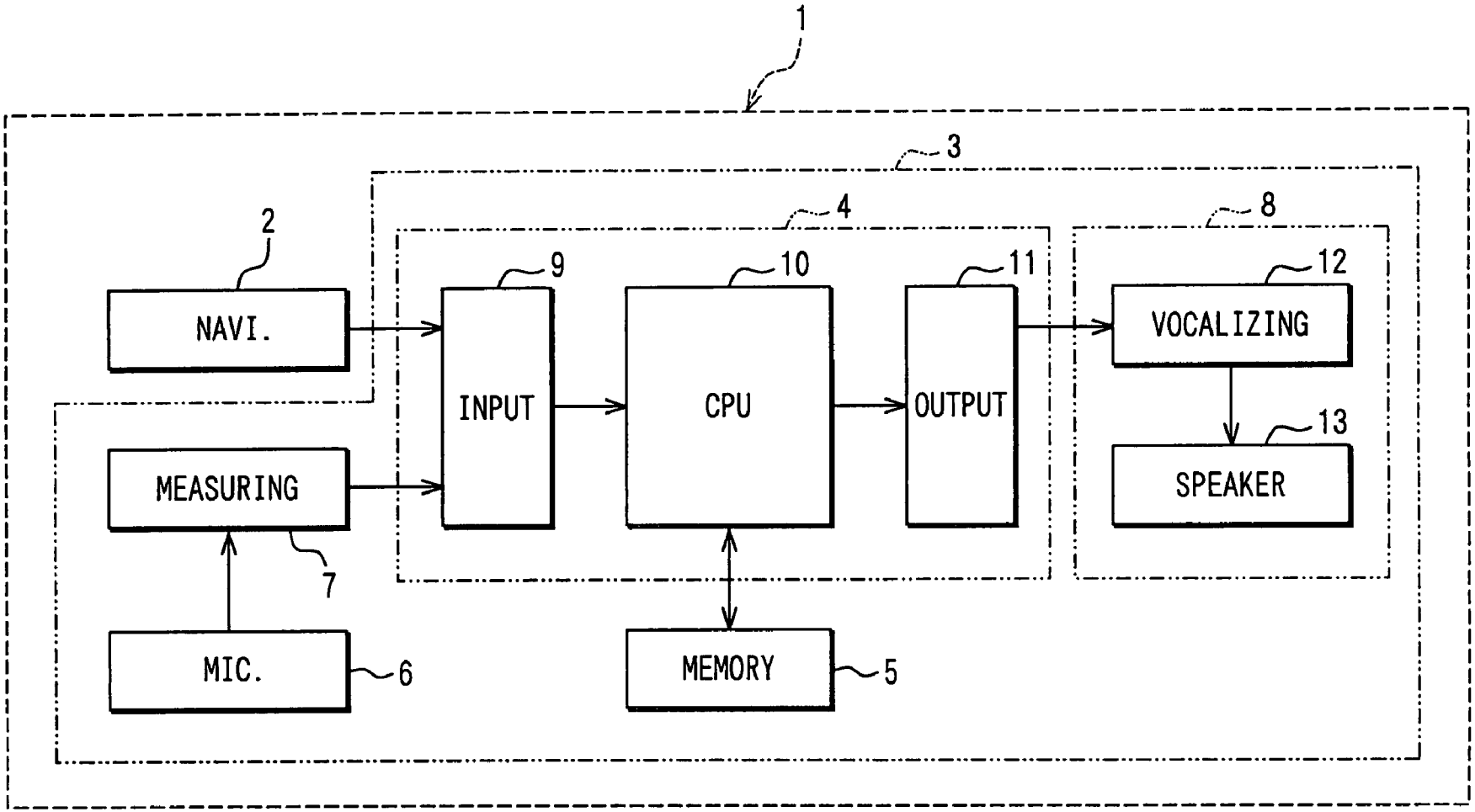
FIG. 1 is a block diagram showing an electrical structure of a car navigation device according to an embodiment of the present invention.

As shown in FIG. 1, the car navigation device 1 mounted in a subject vehicle includes a navigation unit 2 and a voice guidance unit 3. The voice guidance unit 3 includes a voice mixing unit 4, a memory 5, a microphone 6, a voice measuring unit 7, and a voice outputting unit 8.

The navigation unit 2 includes a control circuit that mainly includes a CPU, a ROM, and a RAM; a position detector for detecting a position of the vehicle; a map data input unit, an operation switch group, an external memory, a display unit such as a liquid crystal display; and a remote controller sensor for detecting signals from a remote controller (non shown).

When a user (or a driver) causes the navigation unit 2 to conduct route guidance, the user instructs the navigation unit 2 to conduct a route guidance function and sets a destination, by operating the operating switch group or the remote controller. When the subject vehicle approaches an intersection or a branching point of a guided point (e.g., for turning right or left), the navigation unit 2 works as follows: A window display on the display unit is switched to an enlarged view of an intersection or a branching point. The voice mixing unit 4 is instructed to produce voice data for a voice guidance phrase (e.g., "Turn left 100 meters ahead.").

The memory 5 for storing voice data is a non-volatile memory such as a flush memory or a ROM to store a voice synthesis program and voice data (voice data items) of multiple voice guidance phrases (e.g., "Turn left 100 meters ahead;" or "Do you use an expressway?"). A certain voice guidance phrase is recorded by a female high-pitched voice, a female low-pitched voice, a female medium-pitched voice, a male high-pitched voice, a male low-pitched voice, a male medium-pitched voice, a child high-pitched voice, a child low-pitched voice, and a child medium-pitched voice, and stored as digital data. A voice of a person includes many frequency components. Even when voices have the same main frequency component, the voices sometimes sound differently. Therefore, voices of multiple persons with respect to a female, a male, or a child are favorably recorded and stored as voice data.

The voice measuring unit 7 accepts a response voice via the microphone 6, and measures presence or absence of the response voice, a frequency (or voice range), a volume, and a pronunciation speed.

The voice mixing unit 4 consists of an input circuit 9, a CPU 10, and an output circuit 11. The CPU 10 accepts an instruction signal for producing guidance voice data via the input circuit 9 from the navigation unit 2, and further accepts characteristic data of the response voice via the input circuit 9 from the voice measuring unit 7. The CPU 10 reads multiple voice data items from the memory 5, mixes them, and then outputs the mixed voice data (referred to as mixed voice data) via the output circuit 11 to the voice outputting unit 8.

The voice outputting unit 8 consists of a voice vocalizing unit 12 that produces or vocalizes a mixed voice based on the mixed voice data, and a speaker 13 that is disposed inside a cabin of the vehicle for outputting the mixed voice.

Figure 2:
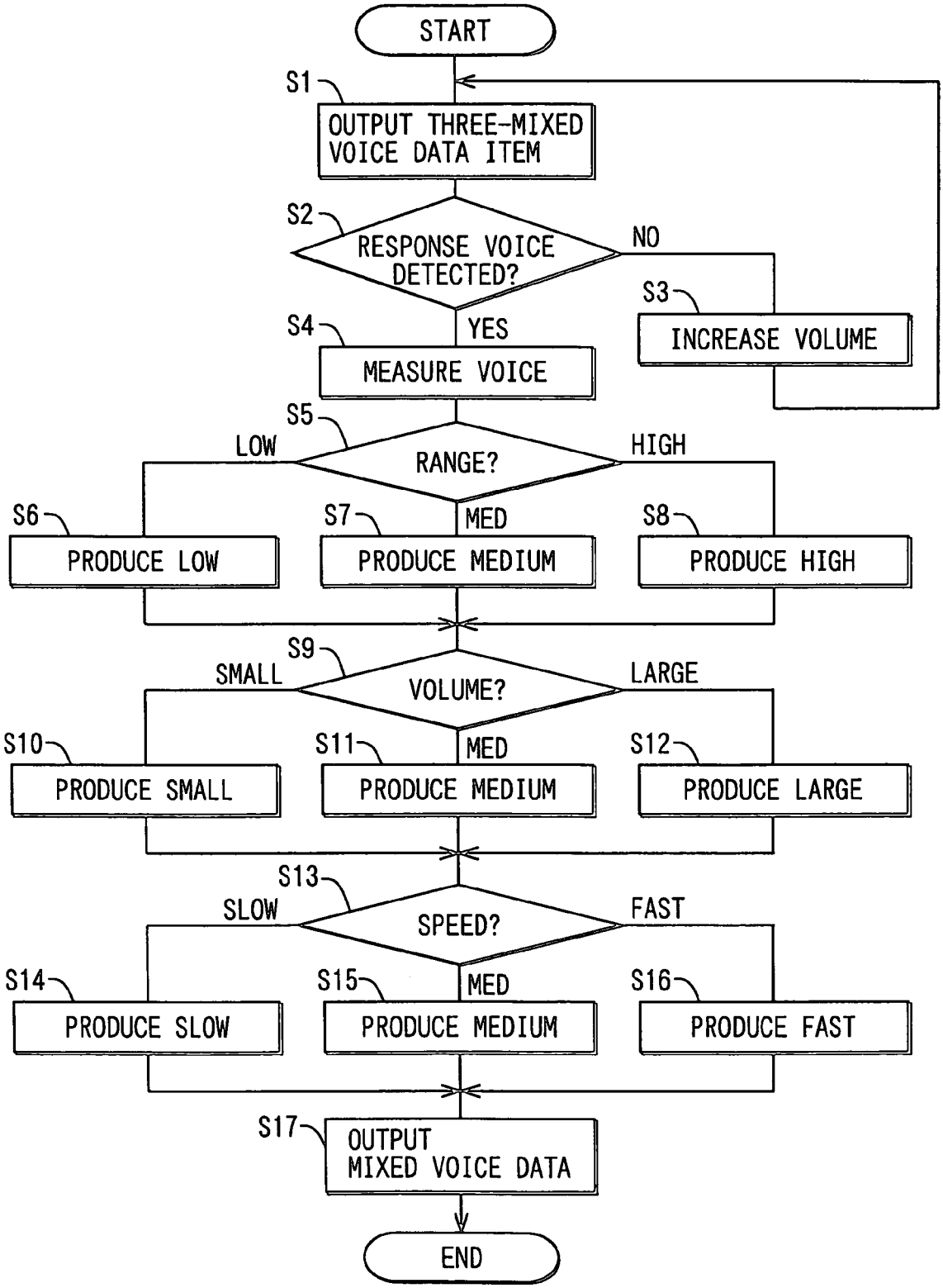
FIG. 2 is a flowchart diagram of a voice synthesizing process.

Next, a function of the embodiment will be explained with reference to FIG. 2. As the car navigation device 1 starts its operation, the CPU 10 reads a voice synthesis program to start a voice synthesizing process. FIG. 2 shows a flowchart of the voice synthesizing process when an instruction signal for producing guidance voice data is received from the navigation unit 2.

For instance, suppose a case that an instruction signal for producing guidance voice data of "Which is a destination?" is accepted. At Step S1, the CPU 10 retrieves three voice data items each of which has a different frequency (or voice range) from the memory 5. The three voice data items correspond to a female medium-pitched voice (high range), a male medium-pitched voice (low range), and a child medium-pitched voice (medium range) with respect to "Which is a destination?" Here, the female voice is the highest, while the male voice is the lowest. A voice of a person includes various frequency components. When a frequency ratio of major components of a certain voice approximates 1:2:4 (harmonic overtone), a harmonic series comes into effect. This produces an effect that this voice sounds as a very comfortable harmonic voice.

The CPU 10 mixes the three voice data items by a volume ratio of 1:1:1, sets the total volume of the mixed voice data to a medium volume, and sets the pronunciation speed to a medium speed. The mixed voice data is converted to a voice by the voice vocalizing unit 12, and the corresponding voice guidance phrase is then outputted from the speaker 13.

The voice measuring unit 7 receives a signal from the microphone 6 and measures presence or absence of a response voice. In this case, to prevent the voice guidance phrase that is outputted from the speaker 13 from being detected, detecting a voice is prohibited while the voice guidance phrase is outputted from the speaker 13. At Step S2, the CPU 10 determines whether a response voice to the outputted voice guidance phrase is detected. When a response voice is determined to be not detected for a given period, the total volume of the mixed voice is increased at subsequent Step S3 and then the guidance voice data of "Which is a destination?" is outputted again at Step S1.

In other words, the car navigation device 1 repeatedly outputs a voice guidance phrase with the volume being gradually increased in given intervals until a response voice is detected. Here, it can be designed as follows: The voice volume and the repetition times have individual upper limits; after the voice volume or the repetition times reaches the upper limit, the voice guidance phrase is then repeatedly outputted with the pronunciation speed being gradually decreased. Furthermore, it can be designed that at Step S3 the pronunciation speed decreases as the total volume increases.

At Step S2, when a response voice is determined to be detected, Step S4 then takes place. Here, the voice measuring unit 7 is instructed to measure, of the response voice, characteristics of a frequency, a volume, and a pronunciation speed, and then to input measurement results to the CPU 10. At Step S5, the CPU 10 determines whether a voice range of the response voice is high or low. When the voice range is determined to be low, Step S6 then takes place. Here, upon recognizing the contents (e.g., "NAGOYA Station") of the response voice, voice data of a low voice range is produced with respect to subsequently outputted voice guidance phrase (e.g., "Do you use an expressway?"). In detail, mixing ratios (or volume ratios) of the female medium-pitched voice and the child medium-pitched voice are decreased while a mixing ratio of the male medium-pitched voice is increased.

Similarly, at Step S5, when the voice range is determined to be medium, Step S7 then takes place. Here, three voice data items of the subsequently outputted voice guidance phrase are mixed by an even ratio of 1:1:1. At Step S5, when the voice range is determined to be high, Step S8 then takes place. Here, guidance voice data having a high voice range is produced with respect to the subsequently outputted voice guidance phrase. In detail, mixing ratios (or volume ratios) of the male medium-pitched voice and the child medium-pitched voice are decreased while a mixing ratio of the female medium-pitched voice is increased. Thus approximating or converging the voice ranges (or frequencies) of the response voice and the voice guidance phrase is based on an empirical rule that hearing-impaired people tend to speak using a voice range by which they themselves relatively easily hear (or where they lose hearing less).

Next, at Step S9, the CPU 10 determines a voice volume of the response voice. When the voice volume of the response voice is determined to be small, Step S10 then takes place. Here, voice data is produced with respect to the subsequently outputted voice guidance phrase so that a total voice volume of the mixed voice becomes as small as that of the response voice.

Similarly, at Step S9, when the voice volume is determined to be medium, Step S11 then takes place. Here, voice data is produced with respect to the subsequently outputted voice guidance phrase so that a total voice volume of the mixed voice becomes as medium as that of the response voice. Furthermore, at Step S9, when the voice volume is determined to be large, Step S12 then takes place. Here, voice data is produced with respect to the subsequently outputted voice guidance phrase so that a total voice volume of the mixed voice becomes as large as that of the response voice. Thus approximating or converging the voice volumes of the response voice and the voice guidance phrase is based on an empirical rule that hearing-impaired people tend to speak by a voice volume by which they themselves relatively easily hear.

Next, at Step S13, the CPU 10 determines a pronunciation speed of the response voice. When the pronunciation speed of the response voice is determined to be slow, Step S14 then takes place. Here, voice data is produced with respect to the subsequently outputted voice guidance phrase so that a pronunciation speed of the mixed voice becomes as slow as that of the response voice.

Similarly, at Step S13, when the pronunciation speed is determined to be medium, Step S15 then takes place. Here, voice data is produced with respect to the subsequently outputted voice guidance phrase so that a pronunciation speed of the mixed voice becomes as medium as that of the response voice. Furthermore, at Step S13, when the pronunciation speed is determined to be fast, Step S16 then takes place. Here, voice data is produced with respect to the subsequently outputted voice guidance phrase so that a pronunciation speed of the mixed voice becomes as fast as that of the response voice. Thus approximating or converging the pronunciation speeds of the response voice and the voice guidance phrase is based on an empirical rule that hearing-impaired people tend to speak by a pronunciation speed at which they themselves relatively easily hear.

At Step S17, the CPU 10 outputs the mixed voice data produced at Steps S4 to S16 and then completes the voice synthesizing process. When a voice guidance phrase outputted at Step S17 is a kind (e.g., "Do you use an expressway?") that requires a response from the user, a control can be adopted that advances the sequence of the process to Step S2 without completing the process. When the voice synthesizing process resumes after once being completed, at Step S1, the CPU 10 can output the mixed voice data having a voice range, a voice volume, and a pronunciation speed equivalent to those of the mixed voice data that is previously outputted at Step S17.

As explained above, according to the embodiment, the following takes place: Voice data are previously stored in a memory 5; with respect to voice data of a certain voice guidance phrase, multiple voice data items are stored that include individually different voice ranges; and with respect to the certain voice guidance phrase, three voice data items having different voice ranges from the multiple voice data items are chosen and mixed, which thereby produces mixed voice data. Thus, the mixed voice for guiding a user or an occupant includes a high-range voice (e.g., a female voice), a low-range voice (e.g., a male voice), and a medium-range voice (e.g., a child voice). Therefore, even for senior people or hearing-impaired people having weak hearing in a certain voice range (or frequency), the voice guidance phrase can be relatively easily heard in a frequency where the hearing loss is relatively small.

In this case, when a frequency ratio of the three mixed voices is set to 1:2:4, a harmonic comfortable voice is produced. Furthermore, with respect to an individual, a person's hearing level (dB) forms a characteristic relationship (hearing characteristic) with a logarithm of a frequency. On a hearing characteristic diagram (audiogram), frequencies of the voices constituting the mixed voice is to be thereby arranged with equal intervals.

Furthermore, in a case that a voice guidance phrase is initially outputted, a total volume of the mixed voice gradually increases until a response voice is detected. Eventually, the voice guidance phrase sounds in a volume suitable for a hearing capability of a user. When a response voice is subsequently received from the user, with respect to the received response voice, characteristics of a frequency, a volume, and a pronunciation speed are measured to thereby produce and output mixed voice data of a voice guidance phrase having the measured characteristics. Therefore, voice guidance can be performed by a voice matching with a hearing capability of the user from an initial step to a final step.

(Others)

In the above embodiment, in the voice synthesizing process in FIG. 2, mixed voice data is produced to have the same characteristics (frequency, volume, and pronunciation speed) of a response voice at Steps S4 to S16. However, it can be alternatively designed. A voice volume of an outputted voice guidance phrase corresponding to a response voice detected at Step S2 is once stored, and then subsequent voice guidance phrases can be outputted in the same volume as the stored volume.

In the voice synthesizing process, three characteristics of a frequency, a volume, and a pronunciation speed are detected; however, it can be designed that one or two of the three characteristics are detected.

Based on the measured voice range of the response voice, the mixing ratio of the three voice data items is determined to produce a mixed voice. However, instead of the mixed voice, a voice guidance phrase of a single voice can be consequently outputted by retrieving voice data of a voice guidance phrase having a frequency similar to that of the response voice from the memory 5.

The frequency ratio of the three voices are set to 1:2:4; however, it can be set to 1:1.5:2 or the like that harmonizes the three voices.

The three voice data items are used for synthesizing the mixed voice data; however, two or more than three voice data items can be used for synthesizing mixed voice data.

The voice guidance device can be adapted not only to the car navigation device, but also widely to another device such as a hand-held navigation device, a hand-held information terminal, an electric household appliance, an elevator, a vehicle, or an automated teller machine, as voice guidance or a voice interface.

Voice data can be also synthesized by a synthesis technology. It can be designed that one of three voice data items is a voice data item previously stored in a memory, while other two voice data items that have different frequencies are synthesized using the stored voice data item. In this case, the memory stores a voice producing program, a voice synthesizing program, and voice data. The CPU 10 reads the foregoing stored voice data and programs and then executes the voice producing program to produce voice data items having different frequencies. The CPU 10 then executes the voice synthesizing program. Under this structure, the numbers of voice data items stored in the memory decreases; furthermore, various voice data items having different frequencies become available for producing the mixed voice data.

It will be obvious to those skilled in the art that various changes may be made in the above-described embodiments of the present invention. However, the scope of the present invention should be determined by the following claims.

What is claimed is:

1. A voice guidance device comprising:

a storing unit that stores a plurality of voice data items for each of a plurality of voice guidance phrases, wherein each of the plurality of voice data items for a specific voice guidance phrase includes the specific voice guidance phrase at a different frequency;

a voice mixing unit that mixes at least two voice data items from a first voice guidance phrase of the plurality of guidance phrases to thereby produce a first mixed voice data item of the first voice guidance phrase;

a voice outputting unit that outputs and sounds only the first voice guidance phrase using a first mixed voice based on the first mixed voice data item;

a voice detecting unit that detects a response voice uttered by a user responding to the outputted first voice guidance phrase using the first mixed voice; and a voice measuring unit that measures a frequency with respect to the detected response voice;

the voice mixing unit producing a second mixed voice data item by mixing at least two voice data items of a second voice guidance phrase from the plurality of voice guidance phrases, different than the first voice guidance phrase and different from the detected response, the second mixed voice data item having the characteristic of the frequency that is measured by the voice measuring unit with respect to the response voice detected after the first mixed voice was sounded;

the voice outputting unit further outputting and sounding only the second voice guidance phrase using a second mixed voice based on the second mixed voice data item in response to the response voice, the second voice guidance phrase approximating the frequency that is measured by the voice measuring unit with respect to the response voice in order to assist the user to hear and understand the second voice guidance phrase.

2. The voice guidance device of claim 1, wherein the voice mixing unit mixes three voice data items for the first voice guidance phrase, wherein the three voice data items individually correspond to a low range voice, a medium range voice, and a high range voice, and wherein the low range voice, the medium range voice, and the high range voice form a harmonic sound.

3. The voice guidance device of claim 1, wherein the voice mixing unit mixes three voice data items for the first voice guidance phrase, a frequency ratio of which is 1: 2: 4, to thereby produce the mixed voice data.

4. The voice guidance device of claim 1, wherein the voice mixing three voice data items for the first voice guidance phrase, a frequency ratio of which is 1: 1.5: 2, to thereby produce the mixed voice data.

5. The voice guidance device of claim 1, wherein the voice mixing unit produces the second mixed voice data item so that a voice volume of the second mixed voice increases as time elapses.

6. The voice guidance device of claim 1, wherein the voice mixing unit determines a mixing ratio of the at least two voice data items based on the frequency, to thereby produce the second mixed voice data item.

7. A navigation device including the voice guidance device according to claim 1.

8. A voice guidance device comprising:

a storing unit that stores a plurality of stored voice data items for each of a plurality of voice guidance phrases, each of the plurality of voice data items for a specific voice guidance phrase including the specific voice guidance phrase at a different frequency;

a voice producing unit that produces at least one produced voice data item for each of the plurality of voice guidance phrases from the plurality of stored voice data items using voice synthesis, wherein each of the plurality of stored voice data items and the at least one produced voice data item of a first voice guidance phrase of the plurality of voice guidance phrases has a different frequency;

a voice mixing unit that mixes at least two voice data items from the first voice guidance phrase to thereby produce a first mixed voice data item of the first voice guidance phrase;

a voice outputting unit that outputs and sounds only the first voice guidance phrase using a first mixed voice for the first voice guidance phrase based on the first mixed voice data item;

a voice detecting unit that detects a response voice responding to the outputted first voice guidance phrase using the first mixed voice; and a voice measuring unit that measures a frequency with respect to the detected response voice;

the voice mixing unit producing a second mixed voice data item by mixing at least two voice data items of a second voice guidance phrase of the plurality of voice guidance phrases, different than the first voice guidance phrase and different from the detected response, the second mixed voice data item having the characteristic of the frequency that is measured by the voice measuring unit with respect to the response voice detected after the first mixed voice was sounded;

the voice outputting unit further outputting and sounding only the second voice guidance phrase using a second mixed voice based on the second mixed voice data item in response to the response voice, the second voice guidance phrase approximating the frequency that is measured by the voice measuring unit with respect to the response voice.

9. The voice guidance device of claim 8, wherein the voice mixing unit mixes three voice data items of the stored plurality of voice data items and the produced at least one voice data item for the first voice guidance phrase, wherein the three voice data items individually correspond to a low range voice, a medium range voice, and a high range voice, and wherein the low range voice, the medium range voice, and the high range voice form a harmonic sound.

10. The voice guidance device of claim 8, wherein the voice mixing unit mixes three voice data items for the first voice guidance phrase, a frequency ratio of which is 1: 2: 4, to thereby produce the mixed voice data.

11. The voice guidance device of claim 8, wherein the voice mixing unit mixes three voice data items for the first voice guidance phrase, a frequency ratio of which is 1: 1.5; 2, to thereby produce the mixed voice data.

12. The voice guidance device of claim 8, wherein the voice mixing unit produces the second mixed voice data item so that a voice volume of the second mixed voice increases as time elapses.

13. The voice guidance device of claim 8, wherein the voice mixing unit determines a mixing ratio of the at least two voice data items based on the frequency, to thereby produce the second mixed voice data item.

14. A navigation device including the voice guidance device according to claim 8.

15. A voice guidance method comprising steps of:

obtaining a plurality of voice data items for each of a plurality of voice guidance phrases, wherein each of the plurality of voice data items for a specific voice guidance phrase includes the specific voice guidance phrase at a different frequency and at least one of the plurality of voice data items is read from a memory and others of the plurality of voice data items are synthesized from the voice data item read from the memory;

producing a first mixed voice data item by mixing at least two voice data items from a first voice guidance phrase selected from the plurality of voice guidance phrases;

outputting and sounding the first guidance phrase using a first mixed voice for the first voice guidance phrase based on the first mixed voice data item;

detecting a response voice uttered by a user responding to the outputted first guidance phrase using the first mixed voice;

measuring a frequency with respect to the detected response voice;

producing a second voice data item by mixing at least two voice data items for a second voice guidance phrase of the plurality of guidance phrases, different than the first voice guidance phrase and different from the detected response, the second mixed voice data item having the characteristic of the frequency that is measured with response to the response voice detected after the first mixed voice was sounded; and outputting and sounding only the second voice guidance phrase using a second mixed voice based on the second mixed voice data item in response to the response voice, the second voice guidance phrase approximating the frequency that is measured with respect to the response voice in order to assist the user to hear and understand the second voice guidance phrase.

16. The voice guidance method of claim 15, further comprising:

producing a second voice data item for the second voice guidance phrase, wherein the second voice data item has the frequency that is measured with respect to the response voice.

17. A voice guidance device comprising:

a storing unit that stores a plurality of voice data items for each of a plurality of voice guidance phrases each of the plurality of voice path items for a specific voice guidance phrase includes the voice guidance phrase at a different frequency;

an obtaining unit that obtains a plurality of voice data items for each of the plurality of voice guidance phrases, wherein each of the plurality of voice data items for each voice guidance phrase has a different frequency, wherein at least one of the plurality of voice data items is read from the storing unit and others of the plurality of voice data items are synthesized from the at least one of the plurality of voice data items read from the storing unit;

a voice mixing unit that mixes at least two voice data items for a first voice guidance phrase of the plurality of voice guidance phrases to thereby produce a first mixed voice data item;

a voice outputting unit that outputs and sounds only the first guidance phrase using a first mixed voice for the voice guidance phrase based on the first mixed voice data item;

a voice detecting unit that detects a response voice uttered by a user responding to the outputted first guidance phrase using the first mixed voice; and a voice measuring unit that measures a frequency with respect to the detected response voice;

the voice mixing unit producing a second mixed voice data item by mixing at least two voice data items for a second voice guidance phrase of the plurality of voice guidance phrases, different than the first voice guidance phrase and different from the detected response, the second mixed voice data item having the characteristic of the frequency that is measured by the voice measuring unit with respect to the response voice detected after the first mixed voice was sounded;

the voice outputting unit further outputting and sounding the second voice guidance phrase using a new mixed voice based on the new mixed voice data item in response to the response voice, the second voice guidance phrase approximating the frequency that is measured by the voice measuring unit with respect to the response voice in order to assist the user to hear and understand the second voice guidance phrase.

* * * * *